United States Patent [19]

König et al.

[11] Patent Number: 4,724,089

[45] Date of Patent: Feb. 9, 1988

[54] TEXTILE TREATMENT COMPOSITIONS

[75] Inventors: Axel König, Wemmel; Francesco de Buzzaccarini, Strombeek-Bever, both of Belgium

[73] Assignee: The Procter & Gamble Company, Cincinnati, Ohio

[21] Appl. No.: 850,791

[22] Filed: Apr. 10, 1986

[51] Int. Cl.[4] ..... D06M 11/00

[52] U.S. Cl. ..... 252/8.8; 252/8.75; 252/8.9

[58] Field of Search ..... 252/8.75, 8.8, 8.9

[56] References Cited

U.S. PATENT DOCUMENTS

| | | | |
|---|---|---|---|
| 2,995,520 | 8/1961 | Luvisi | 252/8.8 |
| 3,644,203 | 2/1972 | Lamberti et al. | 252/8.75 |
| 3,775,316 | 11/1973 | Berg | 252/8.8 |
| 3,904,533 | 9/1975 | Neiditch et al. | 252/8.8 |
| 3,974,076 | 8/1976 | Wiersema et al. | 252/8.8 |
| 4,399,045 | 8/1983 | Burns | 252/8.75 |
| 4,416,811 | 11/1983 | Wixon | 252/8.75 |
| 4,424,134 | 1/1984 | Sissin et al. | 252/8.8 |
| 4,426,299 | 1/1984 | Verbruggen | 252/8.8 |
| 4,450,085 | 5/1984 | Wixon | 252/8.75 |
| 4,454,049 | 12/1984 | MacGilp et al. | 252/8.8 |
| 4,460,485 | 7/1984 | Rapisarda et al. | 252/8.75 |
| 4,464,272 | 8/1984 | Parslow et al. | 252/8.8 |
| 4,585,563 | 4/1986 | Busch et al. | 252/8.8 |
| 4,661,267 | 4/1987 | Dekker et al. | 252/8.8 |
| 4,661,269 | 4/1987 | Trinh et al. | 252/8.8 |

FOREIGN PATENT DOCUMENTS

| | | |
|---|---|---|
| 0000406 | 1/1979 | European Pat. Off. . |
| 1565808 | 4/1980 | United Kingdom . |
| 1601360 | 10/1981 | United Kingdom . |
| 1601758 | 11/1981 | United Kingdom . |
| 2118221 | 10/1983 | United Kingdom . |

OTHER PUBLICATIONS

Fette-Seifen-Anstrichmittel, 74:527-533, 1972, H. W. Eckert, Henkel & Co., Inc. "Condensation Products from β-Hydroxyethylenediamine and Fatty Acids or Their Alkyl Esters and Their Application as Textile Softeners in Washing Agents".

*Primary Examiner*—Paul Lieberman
*Assistant Examiner*—Willie J. Thompson
*Attorney, Agent, or Firm*—Ronald L. Hemingway; Robert B. Aylor; Richard C. Witte

[57] ABSTRACT

Aqueous dispersions of certain amines, with Bronstedt acids having a pKa of at least 6, are stable and are useful as rinse-added fabric softeners.

12 Claims, No Drawings

TEXTILE TREATMENT COMPOSITIONS

This invention relates to textile treatment compositions. More particularly it relates to textile treatment compositions suitable for use in the rinse cycle of a textile laundering operation to provide fabric softening/static control benefits, the compositions being characterized by excellent softening, water dispersibility and storage properties after prolonged storage at both elevated and sub-normal temperatures.

Textile treatment compositions suitable for providing fabric softening and static control benefits during laundering ware well known in the art and have found widespread commercial application. Conventionally, rinse-added fabric softening compositions contain, as the active component, substantially water-insoluble cationic materials having two long alkyl chains. Typical of such materials are di-hardened tallow dimethylammonium chloride and imidazolinium compounds substituted with two tallow groups. These materials are normally prepared in the form of a dispersion in water and it is generally not possible to prepare such aqueous dispersions with more than about 10% of cationic softener without encountering severe product viscosity and storage-stability problems. Although more concentrated dispersions of softener materials can be prepared as described in European Patent Application No. 406 and British Pat. No. 1 601 360 by o,cprprato,g certain nonionic adjunct softening materials therein, such compositions tend to be relatively inefficient in terms of softening benefit/unit weight of active; moreover, product viscosity and stability problems become increasingly unmanageable in more concentrated aqueous dispersions and effectively limit the commercial range of applicability to softener active levels in the range from about 15% to about 20%.

U.S. Pat. No. 4,454,049, issued June 12, 1984 to MacGilp et al discloses concentrated liquid fabric softeners comprising substantial amounts of at least 10%, more typically about 30–40%, of water miscible organic solvent.

U.S. Pat. No. 2,995,520, issued Aug. 8, 1961 to Luvisi et al discloses the use of the acid salts of certain imidazoline derivatives for softening of fibrous materials such as cotton and paper. The treatment baths used for treating textiles contain from 0.001% to 1% of an acid salt of an imidazoline derivative. For shipment, it is said to be desirable to place the materials in a low molecular weight aliphatic alcohol to prevent freezing.

Other patents, more recent than U.S. Pat. No. 2,995,520, also disclose the use of an acid salt of an imidazoline derivative for the softening of fabrics. However, according to the state of the art, quaternary ammonium salts are, in the context of fabric softening, preferred over acid salts of, e.g., acrylic tertiary amines or cyclic amines.

It is therefore an object of the present invention to provide liquid fabric softening compositions that can be formulated as both diluted and concentrated aqueous dispersions without the need of significant amounts of organic solvents. The compositions of the present invention have excellent stability at both elevated and sub-normal temperatures, even under prolonged storage conditions. These compositions further provide excellent softening, anti-static and fabric rewettability characteristics across a broad range of fabric types.

SUMMARY OF THE INVENTION

The present invention provides a stable aqueous dispersion comprising:

(a) from 1% to 40% of an amine selected from the group consisting of the di(higher alkyl)cyclic amines of formula I herein, and the reaction product of higher fatty acids with a polyamine selected from the group consisting of hydroxyalkylene diamines alkylene diamens, N-hydroxyalkyl alkylene diamens, alkoxyalkylene diamens, dialkylene triamines and di(alkoxyalkylene)triamines and mixtures thereof; and (b) a dispersing aid selected from the group of Bronstedt acids having a pKa value of not greater than 6; provided that the pH of the dispersion is not greater than 8.

DETAILED DESCRIPTION OF THE INVENTION

The compositions of the present invention are based upon the discovery that stable aqueous dispersion can be formulated with certain cyclic amines, even at high amine concentration, and a Bronstedt acid as a dispersing aid, without the use of substantial amounts of organic solvent.

(a) The amine

The amines used in the compositions of the present invention are selected from the group consisting of:

(I) compounds of the formula I.

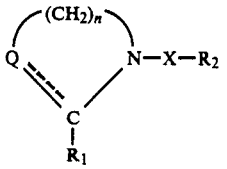

wherein n is 2 or 3, preferably 2; $R_1$ and $R_2$ are, independently, a $C_8$–$C_{30}$ alkyl or alkenyl, preferably $C_{12}$–$C_{20}$ alkyl, more preferably $C_{15}$–$C_{18}$ alkyl, or mixtures of such alkyl radicals. Examples of such mixtures are the alkyl radicals obtained from coconut oil, "soft" (non-hardened) tallow, and hardened tallow. Q is CH, $CH_2$, NH or N, preferably N.

$$X \text{ is } -R_4-T-\underset{\underset{O}{\|}}{C}-$$

wherein T is O or $NR_5$, $R_5$ being H or $C_1$–$C_4$ alkyl, preferably H, and $R_4$ is a divalent $C_1$–$C_3$ alkylene group or $(C_2H_4O)_m$, wherein m is an number of from 1 to 8; or X is $R_4$.

(II) reaction products of higher fatty acids with a polyamine selected from the group consisting of alkylenediamines, N-hydroxyalkylalkylenediamines, alkoxyalkylenediamines, di(alkoxyalkylene)triamines, and dialkylenetriamines and mixtures thereof. These reaction products are mixtures of several compounds in view of the multifunctional structure of the polyamines (see, for example, the publication by H. W. Eckert in Fette-Seifen-Anstrichmittel:, September 1972, pages 527–533, "Condensation Products from Beta-hydroxyethylethylenediamine and fatty acids or their alkyl esters and their application as textile softeners in washing agents".

Some of these reaction products are amines of the formula I herein.

Examples of such reaction products which are not amines of formula I include:

(i) The reaction product of higher fatty acids with hydroxyalkylalkylenediamines in a molecular ratio of about 2;1, said reaction product containing a composition having a compound of the formula:

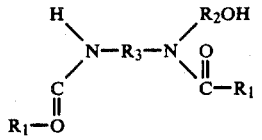

wherein $R_1$ is an acyclic aliphatic $C_{15}$–$C_{21}$ hydrocarbon group and $R_2$ and $R_3$ are divalent $C_1$–$C_3$ alkylene groups and (ii) the reaction product of higher fatty acids with dialkylenetriamines in a molecular ratio of about 2:1, said reaction product containing a composition having a compound of the formula:

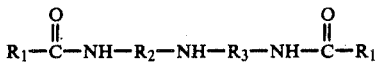

wherein $R_1$, $R_2$ and $R_3$ are defined as in (i).

Compound (i) is commercially available as Mazamide ®6, sold by Mazer Chemicals, or Ceranine ®HC, sold by Sandoz Colors & Chemicals; here the higher fatty acids are hydrogenated tallow fatty acids and the hydroxyalkylalkylenediamine is N-2-hydroxyethylethylenediamine, and $R_1$ is an aliphatic $C_{15}$–$C_{17}$ hydrocarbon group, and $R_2$ and $R_3$ are divalent ethylene groups.

An example of compound (ii) is N, N''-ditallowalkyldiethylenetriamine where $R_1$ is an aliphatic $C_{15}$–$C_{17}$ hydrocarbon group and $R_2$ and $R_3$ are divalent ethylene groups.

The compositions for the present invention comprise from 1% to 40% by weight of the amine, preferably from 4% to 35%, and more preferably from 10% to 35%.

(b) The dispersing aid

Bronstedt acids having a pKa value of 6 or less have been found to be excellent dispersing acids for the amines of the compositions herein. Typically, the amine is heated to a temperature above its melting point. The melt is then slowly added to an aqueous solution of the dispersing aid under vigorous stirring or high shear mixing.

The amount of dispersing aid should be such that the pH of the dispersion, after mixing, is not greater than 5, preferably not greater than 4, and most preferably in the range of from 2.5–4. Typically, the amount of acid is from 1% to 50% by weight of the amine, preferably from 2% to 30%, most preferably from 3 to 15%. The dispersing aid imparts a low viscosity and excellent phase stability to the dispersions, even at high amine concentrations.

Examples of suitable dispersing aids include the inorganic mineral acids carboxylic acids, in particular the low molecular weight ($C_1$–$C_5$) carboxylic acids, and alkylsulfonic acids.

Suitable ionorganic acids include HCl, HBr, $H_2SO_4$, $H_2SO_3$, $HNO_3$ and $H_3PO_4$. Suitable organic acids include formic, acetic, methylsulfonic and ethylsulfonic acid. Preferred acids are phosphoric, formic and methylsulfonic acid.

(c) Organic solvent

The compositions of the present invention can be formulated without the use of any organic solvent. However, the presence of organic solvents (for example, low molecular weight, water mascible aliphatic alcohols,) does not harm the storage stability, the viscosity, or the softening performance of the compositions of this invention. Typically, the amine will be obtained from a supplier of bulk chemicals in solid form of as a solution in an organic solvent, e.g. isopropanol. There is no need, whatsoever, to remove such a solvent in making the compositions of this invention. Indeed, additional solvent may be added, if this is deemed desirable.

However, compared to water, organic solvents are expensive, and difficult to handle because of their flammability and, sometimes, toxicity. It is therefore desirable to formulate the present compositions with low levels of organic solvent, i.e., less than 10%, preferably less than 2%.

(d) Optional quaternary ammonium salt

In addition to the amine and the dispersing aid the dispersions herein optionally further contain a conventional quaternary ammonium softening agent. Examples of such conventional quaternary ammonium salts include (i) acyclic quaternary ammonium salts having the formula:

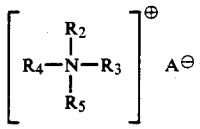

wherein $R_2$ is an acyclic aliphatic $C_{15}$–$C_{22}$ hydrocarbon group. $R_3$ is a $C_1$–$C_4$ saturated alkyl or hydroxyalkyl group, $R_4$ and $R_5$ are selected from $R_2$ and $R_3$, and A is an anion.

(ii) diamido quaternary ammonium salts having the formula:

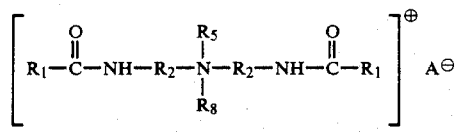

wherein $R_1$ is an acyclic aliphatic $C_{15}$–$C_{21}$ hydrocarbon group, $R_2$ is a divalent alkylene group having 1 to 3 carbon atoms, $R_5$ and $R_8$ are $C_1$–$C_4$ saturated alkyl or hydroxyalkyl groups, and $A^-$ is an anion:

(iii) diamido alkoxylated quaternary ammonium salts having the formula:

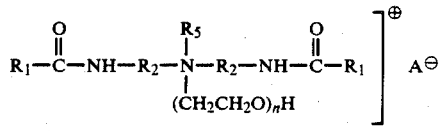

wherein n is equal to 1 to about 5, and $R_1$, $R_2$, $R_5$ and $A^-$ are as defined above;

(iv) quaternary ammonium compounds having the formula:

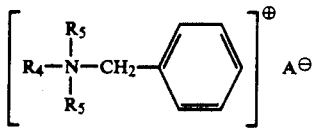

wherein $R_4$ is an acyclic aliphatic $C_{15}$–$C_{22}$ hydrocarbon group, $R_5$ is a $C_1$–$C_4$ saturated alkyl or hydroxyalkyl group, $A^-$ is an anion;

(v) quaternary imidazolinium compounds.

Examples of Component (i) are the well-known dialkyldimethylammoniums salts such as ditallowdimethylammonium chloride, ditallowdimethylammonium methylsulfate, di(hydrodrogenated tallow)dimethylammonium chloride, distearyldimethylammonium chloride, dibehendyldimethylammonium chloride, the monoalkyltrimethylammonium salts such as monotallowtrimethylammonium chloride, mono(hydrogenated tallow)trimethylammonium chloride, palmityltrimethylammonium chloride and soyatrimethylammonium chloride, di(hydrogenated tallow)dimethylammonium chloride and ditallowdimethylammonium chloride are preferred.

Examples of Component (ii) are methylbis(tallowamidoethyl) (2-hydroxyethyl)ammonium methylsulfate and methylbis(hydrogenated tallowamidoethyl) (2-hydroxyethyl)ammonium methylsulfate wherein $R_1$ is an acyclic aliphatic $C_{15}$–$C_{17}$ hydrocarbon group, $R_2$ is an ethylene group, $R_5$ is a methyl group, $R_8$ is a hydroxyalkyl group and A is a methylsulfate anion; these materials are available from Sherex Chemical Company under the trade names Varisoft (R) 222 and Varisoft (R) 110, respectively.

An example of Component (iv) is dimethylstearylbenzylammonium chloride wherein $R_4$ is an acyclic aliphatic $C_{18}$ hydrocarbon group, $R_5$ is a methyl group, $R_5$ is a methyl group and A is a chloride anion, and is sold under the trade names Varisoft (R) SDC by Sherex Chemical Company and Ammonyx ®490 by Onyx Chemical Company.

Examples of (v) are 1-methyl-1-tallowamido-ethyl-2-tallowimidazolinium methylsulfate and 1-methyl-1-(hydrogenated tallowamidoethyl)-methylsulfate. The quaternary ammonium compounds are preferably used at levels in the range of from 0,5% to 10%. The ratio (quaternary ammonium salt): (amine) should not exceed 10:1, and preferably does not exceed 2:1.

(e) Optional silicone Component

The compositions herein can optionally contain an aqueous emulsion of a predominantly linear polydialkyl or alkyl, aryl siloxane in which the alkyl groups can have from one to five carbon atoms and may be wholly or partially fluorinated. Suitable silicones are polydimethyl siloxanes having a viscosity at 25° C. in the range from 100 to 100,000 centistokes, preferably in the range from 1000 to 12,000 centistokes.

The silicone component suitable for use herein is more fully described in British Pat. No. 1,549,180.

(f) Optional nonionics

The compositions optionally contain nonionics as have been disclosed for use in softener compositions. Such nonionics and their usage levels, have been disclosed in U.S. Pat. No. 4,454,049, issued June 12, 1984 to Mac Gilp et al., the disclosures of which are incorporated herein by reference.

Specific examples of nonionics suitable for the compositions herein include glycerol esters (e.g., glycerol monostearate), fatty alcohols (e.g., stearyl alcohol), and alkoxylated fatty alcohols. The nonionic, if used, are typically used at a level in the range of from 0.5–10% by weight of the composition.

(g) Other Optional Ingredients

In order to further improve the stability of the compositions herein, and further adjust their viscosities, these compositions can contain relatively small amounts of electrolyte. A highly preferred electrolyte is $CaCl_2$. It has been found that the Brookfield viscosities of highly concentrated dispersions can be reduced to less than 100 cps, using relatively small amounts of $CaCl_2$ (e.g., 600 ppm).

The compositions herein can optionally contain other ingredients known to be suitable for use in textile softeners. Such adjuvents include perfumes, preservatives, germicides, colorants, dyes, fungicides, stabilizers, brighteners and opacifiers. These adjuvents, if used, are normally added at their conventional levels. However, in the case of composition ingredients utilized for a fabric treatment effect, e.g., perfumes, these materials can be added at higher than normal levels, corresponding to the degree of concentration of the product.

EXAMPLE I

The following aqueous dispersion was prepared:

| | |
|---|---|
| ditallow-imidazoline* | 16% |
| phosphoric acid | 1.2% |
| $CaCl_2$ | 600 ppm |
| perfume | 0.8% |

*1-tallowamidoethyl-2-tallowimidazoline

A melt of the ditallow imidazoline was added to an aqueous solution of the phosphoric acid under high shear mixing. A finely divided dispersion was formed.

Calcium chloride was added as an aqueous solution. Perfume was blended in by stirring.

The resulting dispersion had a Brookfield viscosity of 15 cps and excellent phase stability upon prolonged storage. When added to the rinse cycle of an automatic laundry operation, the composition imparted excellent softness and antistatic properties to the fabrics so treated.

EXAMPLE II

The following aqueous dispersion was prepared:

| | |
|---|---|
| ditallow imidazoline* | 20% |
| methanesulfonic acid | 2.3% |
| $CaCl_2$ | 1800 ppm |
| perfume | 1% |

*1-tallowamidoethyl-2-tallowimidazoline

The dispersion, prepared as described in Example I, had excellent phase stability; the Brookfield viscosity was 80 cps.

Fabrics treated with a 0.2% aqueous bath of the dispersion had excellent softness and anti-static properties.

EXAMPLE III–VIII

The compositions of examples III through VIII are prepared as follows:

The amine(1-tallowamidoethyl-2-tallowimidazoline) was melted and kept at a temperature of 65° C.–80° C., avoiding overheating.

A water seat was made, containing electrolyte ($CaCl_2$), dye, bactericide. The seat was kept at a temperature in the range of from 60° C. to 80° C.

Acid was added to the water seat. The amount of acid needed is a function of the pKa value of the acid, the product matrix, and the desired final pH of the product. Typically, 0.4% of acid (by weight of the composition) is sufficient to obtain a pH of below 8. Greater amounts of acid result in a proportionately lower pH.

The molten amine was then added to the acidified water seat under continuous agitation. The hot product was then trimmed to the desired viscosity by addition of electrolyte. Perfume was added. The product was then cooled under agitation.

| | Ex. III | Ex. IV | Ex. V | Ex. VI | Ex. VII | Ex. VIII |
|---|---|---|---|---|---|---|
| Composition | | | | | | |
| amine(1) | 16% | 16% | 16% | 16% | 16% | 5.8% |
| acid | 0.945% HCl | 0.851% HCl | 0.473% HCl | 1.87% lactic | 1.19% formic | 0.94% lactic |
| $CaCl_2$ | 875 ppm | 750 ppm | 1000 ppm | 1500 ppm | 875 ppm | 83 ppm |
| perfume | 0.75% | 0.75% | 0.75% | 0.75% | 0.75% | 0.25% |
| water | balance | balance | balance | balance | balance | balance |
| Phys. Prop. | | | | | | |
| PH(2) | 2.88 | 5.07 | 7.03 | 5.10 | 3.40 | 5.30 |
| Viscosity (cps) | | | | | | |
| fresh | 92 | 97 | 117 | 142 | 108 | 49 |
| after 1 week | 72 | 90 | 100 | 90 | 82 | 23 |
| after 1 month | 73 | 88 | 95 | 64 | 74 | 28 |

(1)1-tallowamidoethyl-2-tallowimidazoline
(2)10% dilution in dist. water.

All compositions were phase stable during 3 months testing at amoxent temperature. All samples had a good viscosity behaviour over a wide (4° C.–35° C.) temperature range.

EXAMPLES IX–XII

The following compositions are prepared as described for examples III–VIII.

| | Ex IX | X | XI | XII |
|---|---|---|---|---|
| amine(1) | 8% | 10% | 20% | 25% |
| Acid | 0.8%(2) | 0.6%(3) | 1.2%(4) | 0.9%(5) |
| $CaCl_2$ (ppm) | 200 | 400 | 900 | 1200 |
| PDMS(6) | 1% | — | — | 1.5% |
| GMS(7) | — | — | 1% | 0.5% |
| Stearyl alc. | — | 1% | — | 0.5% |
| Perfume | 0.5% | 0.6% | 1% | 1% |

(1)1-tallowamidoethyl-2-tallowimidazoline
(2)$H_3PO_4$
(3)methylsulfonic acid
(4)butanoic acid
(5)HBr
(6)polydimethylsiloxane, having a viscosity of 8000 centistrokes
(7)glycerylmonostearate.

We claim:

1. A stable aqueous dispersion comprising:

(a) from 1% to 40% of an amine selected from the group consisting of di(higher alkyl)cyclic amines of the formula:

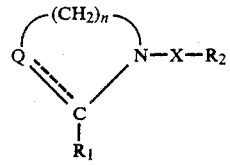

wherein n is 2 or 3, $R_1$ and $R_2$ are, independently, a $C_8$–$C_{30}$ alkyl or alkenyl radical, or mixtures of such radicals. Q is CH, $CH_2$, NH or N, X is

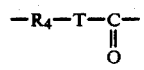

wherein T is $NR_5$, $R_5$ being H or $C_1$–$C_4$ alkyl, and $R_4$ is a divalent $C_1$–$C_3$ alkylene group or $(C_2H_4O)_m$, wherein m is a number of from 1 to 8; or X is $R_4$;

(b) a dispersing aid selected from the group of Bronstedt acids having a pKa value of not greater than 6; provided that the pH of the dispersion is not greater than 5; and (c) at least about 83 ppm of an inorganic electrolyte salt as a viscosity adjusting agent;

the said composition being prepared by a process whereby the amine is melted and then added, with continuous agitation, to an aqueous solution of the Bronstedt acid.

2. A dispersion according to claim 1 comprising from 3% to 35% of the amine.

3. A dispersion according to claim 2 having a pH not greater than 4.

4. The aqueous dispersion of any one of the preceding claims wherein the dispersing aid is an acid selected from the group consisting of the inorganic mineral acids and the organic acids of the formula R—COOH or R—$CH_2$—$SO_3H$, wherein R is hydrogen or $C_1$ to $C_4$ alkyl; and mixtures thereof.

5. The aqueous dispersion of claim 4 wherein the dispersing aid is selected from the group consisting of formic acid, phosphoric acid and methylsulfonic acid.

6. The aqueous dispersion of claim 4 which additionally comprises from 0.5% to 10% of a conventional quaternary ammonium softening compound of the formula

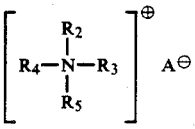

wherein $R_2$ is an acyclic aliphatic $C_{15}$–$C_{22}$ hydrocarbon group, $R_3$ is a $C_1$–$C_4$ saturated alkyl or hydroxyalkyl group, $R_4$ and $R_5$ are selected from $R_2$ and $R_3$; and A is an anion.

7. A dispersion according to claim 4 which further comprises an emulsion of a predominently linear di($C_1$–$C_5$)alkyl or $C_1$–$C_5$ alkylaryl siloxane in which the alkyl groups may be partially or wholly fluorinarted and which may be substituted with cationic nitrogen groups, the siloxane having a viscosity at 25° C. of at least 100 centistokes and up to 8000 centistokes; the weight ratio of the siloxane content of the emulsion to the amine component being in the range of from 5:1 to 1:100.

8. A dispersion according to claim 7 wherein the siloxane is a polydimethyl siloxane.

9. A dispersion according to claim 4 which further comprises from 0.5% to 10% of a nonionic selected from the group consisting of glycerol esters, fatty alcohols and alkoxylated fatty alcohols.

10. A dispersion according to claim 4 wherein the amount of dispersing aid is from 3% to 50% by weight of the amine.

11. A stable aqueous dispersion for use as a rinse-added fabric softener comprising (a) from 4% to 35% of 1-tallowamidoethyl-2-tallow imidazoline;

(b) as a dispersing aid, from 5% to 30% by weight of the imidazoline (a), of an acid selected from the group consisting of HCl, HBr, $H_2SO_4$, $H_2SO_3$, $H_3PO_4$, formic acid, acetic acid, methylsulfonic acid and ethylsulfonic acid;

(c) from 0% to 10%, by weight of the dispersion, of a conventional quaternary ammonium softening agent;

(d) from 0% to 10%, by weight of the dispersion, of a low molecular weight, water miscible, aliphatic alcohol; and (e) at least about 83 ppm of an inorganic electrolyte salt as a viscosity adjusting agent;

the said composition being prepared by a process whereby components (a) and (c) are melted and added, with continuous agitation, to an aqueous solution of (b).

12. The composition of claim 11 additionally comprising an emulsion of a polymethyl siloxane having a viscosity at 25° C. of from 100 to 100,000 centistokes, the weight ratio of the siloxane component to the amine (a) being in the range of from 2:1 to 1:10.

* * * * *